US006325561B1

(12) United States Patent
Reynolds

(10) Patent No.: US 6,325,561 B1
(45) Date of Patent: Dec. 4, 2001

(54) LOTION DISPENSER AND APPLICATOR

(76) Inventor: Deborah Ann Reynolds, 9512 Porto Rosa Dr., Elk Grove, CA (US) 95624

( * ) Notice: Subject to any disclaimer, the term of this patent is extended or adjusted under 35 U.S.C. 154(b) by 0 days.

(21) Appl. No.: 09/522,670

(22) Filed: Mar. 11, 2000

(51) Int. Cl.[7] ..... B43K 7/12
(52) U.S. Cl. ..... 401/117; 401/126
(58) Field of Search ..... 401/117–130

(56) References Cited

U.S. PATENT DOCUMENTS 4,135,274 * 1/1979 Freeman ..... 15/244.1
4,869,612 * 9/1989 Mooney et al. ..... 401/130
6,059,474 * 5/2000 Huang ..... 401/129

* cited by examiner

*Primary Examiner*—David J. Walczak
*Assistant Examiner*—Peter deVore

(74) *Attorney, Agent, or Firm*—Risto A. Rinne, Jr.

(57) ABSTRACT

An apparatus for the containment and dispensing of a lotion directly to the body of a user includes a container with a first opening and a cap adapted to cover the first opening. A center member is attached to the cap and extends in the container into a lotion that is housed within the container when the cap is disposed so as to cover the first opening. A lotion applicator portion is detachably-attached to a distal end of the center member. An extensible member is disposed in the center member and is adapted to retract therein or to extend therefrom sufficient to increase the combined length of the center member and the extensible member thereby permitting the applicator portion to reach a more remote part of the body of the user. A wiper is disposed in the container and is used to remove excess lotion from the center member and from the lotion applicator portion when the cap is removed from the container. An optional second opening includes a refill cap and is used to clean or to refill the container.

8 Claims, 1 Drawing Sheet

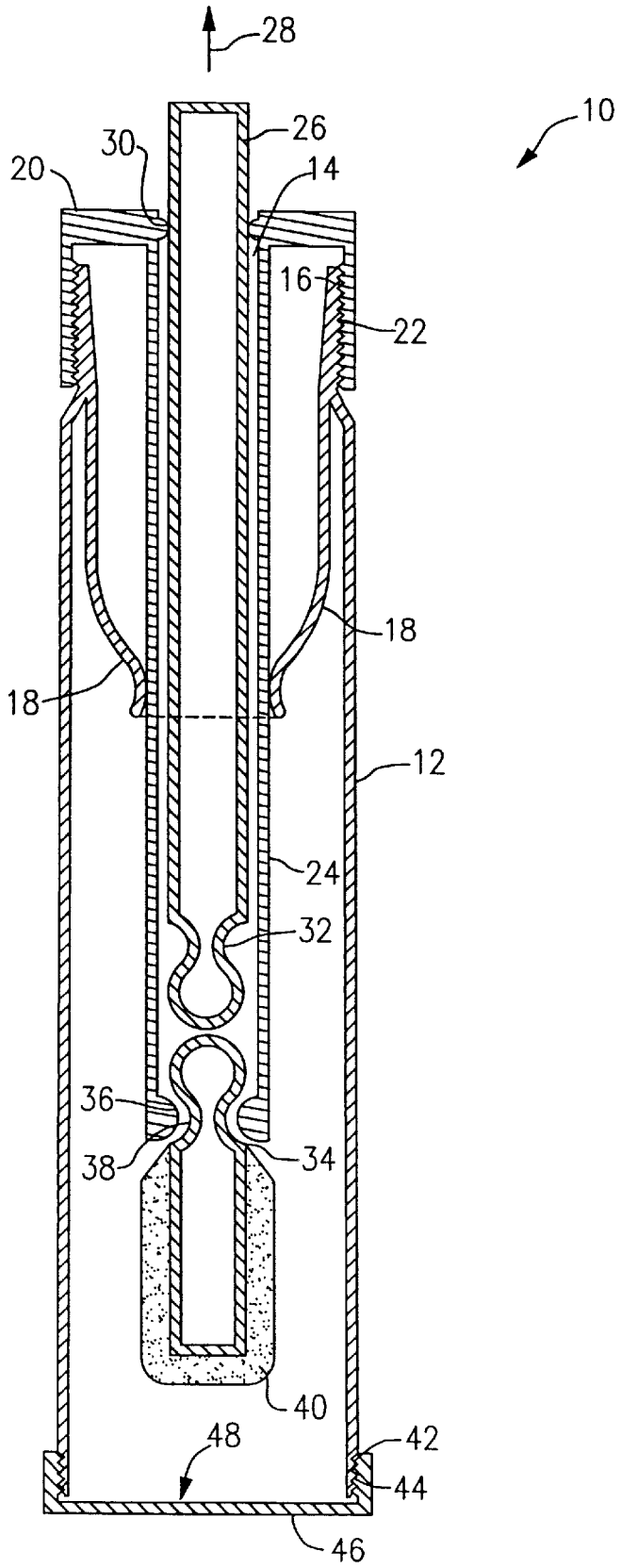
28
10
26
30
14
20
16
22
18
18
12
24
32
36
38
34
40
48
42
44
46

LOTION DISPENSER AND APPLICATOR

BACKGROUND OF THE INVENTION

1. Field of the Invention

The present invention, in general relates to dispensing devices and, more particularly, to devices that dispense and apply a lotion, such as a suntan, medicinal, or body-lotion to the body.

There has been a long-standing need to dispense lotions of all types. Some of the more common types of lotions include the many varieties of body-lotions. Body-lotions are commonly used to moisturize, smooth, and generally to refresh the skin, although some other types of body-lotions may claim a more novel benefit.

Suntan or sun-blocking types of lotions are also routinely applied to all exposed body areas.

Lotions are also available by either prescription or as an over-the-counter drug useful to treat various disorders of the skin. For example, cortisone creams and other similar medications are available to treat common skin maladies.

Difficulty in applying any type of a lotion to a remote or a distal area of the body often arises. This problem is exacerbated among the elderly who may experience an increased lack of flexibility. For example, applying a lotion to his or her own feet, if that person is elderly, can present a significant challenge to overcome.

Similarly, those with injuries or other disabilities find it difficult, at times, to apply lotions to their bodies.

It is also quite common for even those who are youthful and healthy to struggle when attempting to apply a lotion to certain areas of their body, such as to the center of the back.

Lotion applicator devices are known and are basically sponges attached to a stick-like member. While these types of devices are useful in reaching remote or distal areas of the body they cause an excessive amount of waste of the lotion.

This is because the lotion must be applied to the sponge area sufficient first to saturate it. An additional quantity of lotion must then be applied to the sponge sufficient to provide an excess on the sponge that can be transferred to the skin when the sponge area is contacted with the body.

The amount of lotion that is required to saturate the sponge is unavailable for application to the body and is therefore waste. This amount of waste is multiplied by the number of times the sponge is cleaned between uses, as is described in greater detail hereinafter.

The excess quantity of lotion above that required to saturate the sponge is difficult to measure. If too little is applied, an insufficient amount of lotion is applied to the body. Conversely, if too much lotion is applied to the sponge, then an excess amount is invariably applied to the body as well at the initial point the sponge contacts the body. Therefore, a further problem of the prior art is difficulty in regulating an appropriate quantity of lotion to be applied.

As some types of lotions, especially those available only by prescription, are expensive, reducing waste is an important consideration.

Another problem is drying of the lotion on the sponge. Failure to remove (i.e., clean) the lotion from the sponge can cause some types of residual lotion that may be left on the sponge to decay, ferment, or possibly even to serve as a food source for micro-organisms. This, in turn, necessitates having to wash the sponge after each application of lotion to the body has occurred.

Simple hygiene habits for many people would require that they clean the sponge between uses, regardless of any deleterious effects of doing so.

Cleaning lotion off of the sponge exacerbates waste in that even the degree of lotion normally required to saturate the sponge is lost between uses.

Another problem with any prior art device is limited reach, especially if the applicator portion itself serves as, or includes as a component thereof, a container. It is simply not practical to make a lotion container and applicator combination sufficiently long so as to facilitate reaching the most remote or distal areas of the body.

Accordingly there exists today a need for a lotion dispenser and applicator that enables application to distal areas of the body and which lessens waste.

Clearly, such an apparatus would be a useful and desirable device.

2. Description of Prior Art

Lotion dispensers and applicators are, in general, known. For example, the following patents describe various types of these devices:

U.S. Pat. No. 3,103,682 to Markle, Sep. 17, 1963;

U.S. Pat. No. 4,135,274 to Freeman, Jan. 23, 1979;

U.S. Pat. No. 4,483,356 to Kales, Nov. 20, 1984;

U.S. Pat. No. 4,961,661 to Sutton et al., Oct. 9, 1990;

U.S. Pat. No. 5,240,339 to DeForest et al., Aug. 31, 1993;

U.S. Pat. No. 5,360,111 to Arispe, Nov. 1, 1994; and

U.S. Pat. No. Design 404,125 to Weinstein, Jan. 12, 1999.

In addition, in the spring 1997 catalog "Healthy Living", on page 19 a device for applying lotion entitled "Lotion Applicator" was found as was a device in the summer 1999 catalog "Walter Drake" on page 44, entitled "L Applique".

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a lotion dispenser and applicator that contains a lotion.

It is also an important object of the invention to provide a lotion dispenser and applicator that dispenses a lotion.

Another object of the invention is to provide a lotion dispenser and applicator that includes a member for applying a lotion to a remote area of the body.

Still another object of the invention is to provide a lotion dispenser and applicator that includes a telescoping (i.e., an extensible) member for applying a lotion to a remote area of the body.

Still yet another object of the invention is to provide a lotion dispenser and applicator that includes a wiper useful for removing excess lotion from the member or from the applicator.

Yet another important object of the invention is to provide a lotion dispenser and applicator that includes an optional second opening in the container useful for refilling of the container.

Still yet another important object of the invention is to provide a lotion dispenser and applicator that includes a cap to which the member is attached, the cap being removable from the container.

Briefly, a lotion dispenser and applicator apparatus for use in containing and dispensing a lotion that is constructed in accordance with the principles of the present invention has a container with an opening. The container is used to house the lotion. A center member with a lotion applicator that is attached to one end thereof is adapted for insertion through the opening. The center member includes a cap that is detachably-attachable with respect to the opening. The lotion applicator is disposed in the container when the cap is in a first closed position. The cap is adapted for removal apart from the container. The lotion applicator includes a sponge that is adapted for applying the lotion to the body of a user. The center member includes an extensible segment useful to extend its overall length. The container includes a wiper that is adapted to remove excess lotion from the lotion applicator when it is removed from the container. An optional second opening is provided in the container to aid in refilling the container.

BRIEF DESCRIPTION OF THE DRAWINGS

FIG. 1 is a cross-sectional view of a lotion dispenser and applicator.

DETAILED DESCRIPTION OF THE INVENTION

Referring to FIG. 1 is shown, a lotion dispenser and applicator, identified in general by the reference numeral 10.

A container 12 houses lotion (not shown) therein. The container 12 includes a first opening 14 at one end thereof that provides access to the interior portions of the container 12 and it includes a first set of male threads 16 proximate the first opening 14.

Attached to the container 12 proximate the first opening 14 is a wiper 18. The wiper 18 includes a flexible film that is generally cone-shaped and extends toward the inside of the container 12.

The wiper 18 is useful in removing excess lotion and is described in greater detail hereinafter.

A cap 20 includes first female threads 22 and is adapted to fasten over the first opening 14.

The cap 20 includes a center member (i.e., a rod) 24 that extends past the wiper 18 into the container 12 when the cap 20 is securely fastened to the container 12.

Disposed in the center member 24 is an extensible member 26. The extensible member 26 can be pulled in the direction as shown by a first arrow 28.

When the extensible member 26 is fully extended, a first ring 30 that is attached to the cap 20 protrudes therefrom and engages a first groove 32 that is formed in a distal end of the extensible member 26 thereby limiting the maximum amount of extension that is possible for the extensible member 26 and also securing it in an extended position with respect to the cap 20.

It is important to secure the extensible member 26 in the extended position so that a back and forth type of force that is applied to the extensible member 26 by a user (not shown) attempting to apply the lotion is more effectively transferred to an applicator portion 34 and thereby better able to move the applicator portion 34.

The center member 24 includes a second ring 36 at a distal end thereof. The second ring 36 creates a protrusion that extends further inside of the center member 24. The second ring 36 is adapted to receive a second groove 38 of the applicator portion 34 to the center member 24.

The container 12, cap 20, wiper 18, center member 24, extensible member 26, and applicator portion 34 are generally cylindrical in shape. The view of FIG. 1 is as if the lotion dispenser and applicator 10 were cut in half, along a center longitudinal axis thereof.

The applicator portion 34 includes a sponge 40 attached thereto that generally surrounds it. The sponge 40 is adapted to absorb the lotion and when contacted with the body of the user to dispense the lotion to the body, as desired. The sponge 40 includes any absorbent or other suitable type of material, including cloth, etc.

An advantage provided is that if a uniquely shaped sponge (not shown) is attached to a uniquely shaped applicator portion (not shown) and they are required to more effectively administer the lotion to a particular part of the body, then the applicator portion 34 is simply removed apart from the center member 24 by pulling it with sufficient force so that the second groove 38 slips past the second ring 36 thereby freeing the applicator portion 34. Of course, this would be accomplished once the cap 20, including the center member 24, extensible member 26, and applicator portion 34 had all been removed from the container 12.

At that time, the new uniquely shaped applicator portion would be attached by pushing its tip into the end of the center member 24 sufficient to engage the second groove (not shown) of the uniquely shaped applicator with the second ring 36.

Replacement of the applicator portion 34 is also warranted for a number of reasons. For example, if a modified sponge (not shown) that has a different texture or lotion retaining quality is needed, a new applicator portion 34 (with a new type of sponge) is added.

A replacement of the applicator portion 34 having a standard shape and configuration is used whenever the existing one is deemed to be worn out from use.

Also, if the user wishes to use the container 12 to house and dispense a new type of lotion, rather than clean (i.e. remove) the old lotion from the applicator portion 34, a new and clean applicator portion 34 may instead be used.

As such, the lotion dispenser and applicator 10 is versatile and adapted to refurbishing as desired or as required.

When the cap 20 is unscrewed and removed from the container 12, the wiper 18 contacts the outside surface of the center member 24 sufficient to scrape (i.e., to squeegee) off any excess lotion.

This is important because when lotion is being applied to the body, only the sponge 40 is intended to transfer lotion from the lotion dispenser and applicator 10 to the body. There would be no way to predict how much lotion would adhere to the center member 24, this being in part a characteristic of the type of the lotion being applied. Many other factors, such as temperature, would also affect the amount of lotion that would adhere to the center member 24.

Accordingly, the wiper 18 cleans the center member 24 so that only trace amounts of lotion remain on it that are of no concern. The trace amounts of lotion that remain on the center member 24 are not likely to drip or cause spills either.

As the cap 20 is pulled from the container 12, the wiper 18 expands as needed so that it contacts and cleans the sponge 40 removing excess lotion therefrom as well.

A distal end of the container 12 optionally includes a second set of male threads 42 that engage a second set of female threads 44. The female threads are attached to a refill cap 46. When the refill cap 46 is removed from the container 12 a second opening 48 is provided for cleaning and refilling of the container 12 with lotion.

In use, the extensible member 26 is pulled into full extension and the cap 20 is then unscrewed and removed from the container 12 along with the applicator portion 34 that contains the proper amount of lotion, after having been cleaned by the wiper 18 during its removal from the container 12.

Lotion is applied to the body and the cap 20 is screwed back onto the container 12. This forces the applicator portion 34 back into the lotion in the container 12, thereby preventing the lotion on the sponge 40 from drying out while maintaining the sponge 40 in a fully saturated state at all times.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A lotion dispenser and applicator apparatus, comprising:

(a) a container having a first opening;

(b) a cap adapted to cover said first opening;

(c) a center member attached to said cap and extending inside said container when said cap is covering said first opening;

(d) a sponge attached to said center member;

(e) an extensible member partially disposed in said center member, said extensible member adapted to be disposed in a first retracted position in said center member and to be urged into a second extended position; and (f) a second opening in said container, said second opening disposed at an opposite end of said container with respect to said first opening and wherein said first opening and said second opening are adapted to provide access to a common interior space, wherein when said extensible member is disposed in said second extended position the combined length of said center member and said extensible member is greater than when said extensible member is in said first retracted position.

2. The lotion dispenser and applicator of claim 1 wherein said container includes means for removing an excessive amount of lotion from said center member.

3. The lotion dispenser and applicator of claim 1 wherein said container includes means for removing an excessive amount of lotion from said sponge.

4. The lotion dispenser and applicator of claim 1 including means for detachably-attaching said sponge with respect to said center member.

5. The lotion dispenser and applicator of claim 1 including means for retaining said extensible member in said second extended position.

6. The lotion dispenser and applicator of claim 5 wherein said means for retaining said extensible member in said second extended position includes a first ring attached to said cap and a first groove attached to said extensible member whereby when said extensible member is fully extended into said second extended position, said first groove aligns with said first ring.

7. The lotion dispenser and applicator of claim 1 wherein said cap includes first female threads and said container includes first male threads and wherein said first male threads are adapted to cooperate with said first female threads to secure said cap to said container.

8. The lotion dispenser and applicator of claim 1 wherein said second opening includes second male threads that are adapted to cooperate with second female threads that are attached to a refill cap.

* * * * *